United States Patent [19]

Tamura

[11] Patent Number: 4,514,081

[45] Date of Patent: Apr. 30, 1985

[54] IMAGE MAKING SYSTEM AND APPARATUS THEREFOR

[75] Inventor: Yasuyuki Tamura, Kawasaki, Japan

[73] Assignee: Canon Kabushiki Kaisha, Tokyo, Japan

[21] Appl. No.: 465,576

[22] Filed: Feb. 10, 1983

Related U.S. Application Data

[63] Continuation of Ser. No. 347,933, Feb. 11, 1982.

[30] Foreign Application Priority Data

Feb. 17, 1981 [JP] Japan ..... 56-22106

[51] Int. Cl.[3] ..... G03G 15/00

[52] U.S. Cl. ..... 355/14 R; 355/3 R; 355/8; 355/3 SH

[58] Field of Search ..... 355/4, 14 R, 3 R, 8, 355/14 SH, 3 SH; 430/43; 118/645

[56] References Cited

U.S. PATENT DOCUMENTS 4,307,957 12/1981 Kitagawa et al. ..... 355/14 R 4,391,507 7/1983 Mori et al. ..... 355/14 R

*Primary Examiner*—A. C. Prescott

*Attorney, Agent, or Firm*—Fitzpatrick, Cella, Harper & Scinto

[57] ABSTRACT

In an image making system for forming a combined image on a recording medium on the basis of an optical image having scanned an original resting on an original carriage and an information image provided by a light beam controlled by an information signal, an optical image application termination timing is made constant with the scanning termination side of the original carriage as the original placement standard, and an optical image application start timing and an information image application timing are set on the basis of said standard to thereby effect the control of image making.

2 Claims, 15 Drawing Figures

FIG. 7
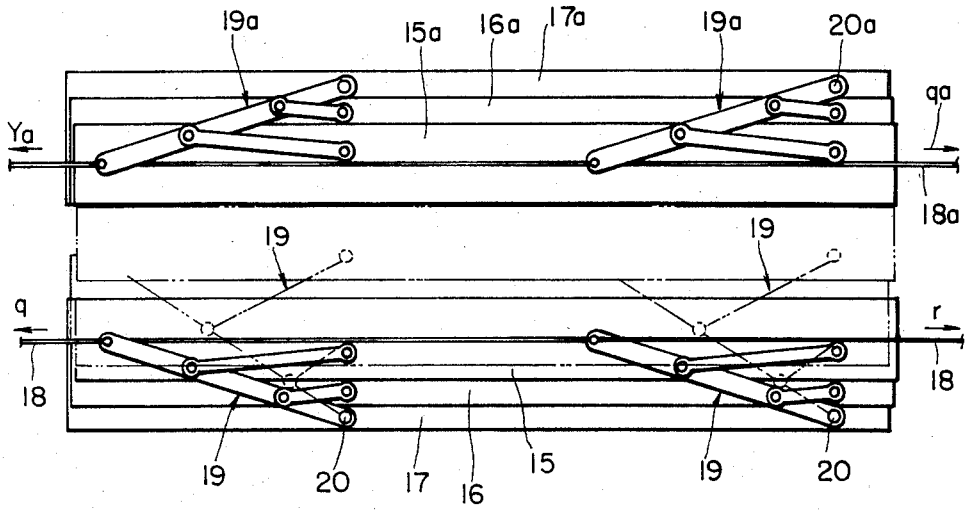
FIG. 8A
FIG. 8B
FIG. 8C
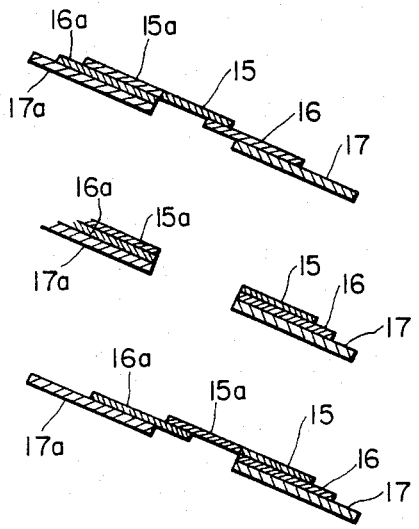

IMAGE MAKING SYSTEM AND APPARATUS THEREFOR

This is a continuation of application Ser. No. 347,933, filed Feb. 11, 1982, now abandoned.

BACKGROUND OF THE INVENTION

1. Field of the Invention

This invention relates to an image making system and an apparatus therefor, and more particularly to a novel, excellent image making system which enables the formation of a combined image of an optical image of an original and an information image based on a light beam modulated by an information signal and an apparatus therefor.

2. Description of the Prior Art

There are known laser printers, CRT printers, etc. in which printed images are obtained by exposing a recording medium such as an electrophotographic photosensitive medium to a laser light or a light spot of CRT tube modulated by an electrical signal. These apparatus are usually used as the output printers of computers, word processors, etc. and would be more convenient if original images such as figures or graphs can be inserted during the printing to thereby form a combined image.

As an example of such apparatus, mention can be made of the apparatus disclosed, for example, in U.S. Pat. No. 4,122,462 (issued to Hirayama et al on Oct. 24, 1978). This is also known a method of combining images by constructing the apparatus so that both a laser light or a light by an optical fiber tube (OFT) and an original image can be applied onto an electrophotographic photosensitive medium and selectively changing over the two to thereby effect combination of images provided by the original image and electrical signal.

Where the image combination as described above is carried out by the utilization of an ordinary electrophotographic copying apparatus, it is usually the case with the copying apparatus of this type that the side on which effective scanning of the original carriage is started is determined as the reference position and an original is placed while being adjusted to that reference position and when the scanning of the original is started, feeding of transfer paper is started in synchronism with scanning means which scans the reference position. A latent image corresponding to the optical image of the original is formed on the photosensitive medium, and then developed. The transfer paper is fed synchronously so that it arrives at an image transfer station when the developed image arrives at the image transfer station. The optical image is recorded at a predetermined location of the transfer paper.

Again during the formation of a combined image, image formation is started concomitantly with the original carriage scanning start timing and feeding of the transfer paper is also started at the same time. Of course, in this image formation process, the optical image of the original and the information image based on the light beam modulated by an information signal are selectively provided in accordance with the combined image. However, in the case of a layout wherein an information image portion is first disposed and the optical image of the original is disposed in the subsequent portion as a combined image in such an image making system (see FIG. 1B of the accompanying drawings), the original must be disposed at the center of the original carriage which is deviated from the scanning start side reference position of the original carriage (see FIG. 1B of the accompanying drawings).

Accordingly, in the formation of the combined image, in order to put the original image into a desired location, it is necessary to look for the corresponding location on the original carriage and place the original on the original carriage in accordance therewith. However, the image by the electrical signal is invisible before it is printed and therefore, the above-described position adjusting operation is very difficult to do.

Moreover, where the original image $L_0$ is disposed at the center and information images $L_1$ and $L_2$ are disposed at the fore and the rear as shown in FIG. 1A, it is necessary to read the fore end and rear end positions of the original image $L_0$ disposed at the predetermined central location on the original carriage 1 by means of a scale 1*a* provided on one side edge of the original carriage 1 and to set the control timing, and the operation for accurately obtaining a desired combined image becomes very complex.

SUMMARY OF THE INVENTION

It is an object of the present invention to provide a novel, excellent image making system and an apparatus therefor.

It is another object of the present invention to provide an image making system which readily enables the optical image of an original and an information image based on a light beam modulated by an information signal to be combined to thereby form a combined image and an apparatus therefor.

It is still another object of the present invention to provide an image making system which enables obtainment of a combined image by a simple step control.

It is yet still another object of the present invention to provide an image making apparatus which enables obtainment of a combined image by a simple control mechanism.

The present invention consists in an image making system for forming a combined image on the basis of an optical image having scanned an original resting on an original carriage and an information image based on a light beam modulated by an information signal such as an electrical signal, characterized in that an optical image application termination timing is made constant with the scanning termination side of the original carriage as the original placement standard and an optical image application start timing and an information image application timing are set on the basis of said standard to thereby effect the control of image making.

The invention will become more fully apparent from the following detailed description thereof taken in conjunction with the accompanying drawings.

BRIEF DESCRIPTION OF THE DRAWINGS

FIG. 7 is a front view of a shutter for original image light in the apparatus of FIG. 4.

FIGS. 8A–C are side cross-sectional views illustrating the operation of the FIG. 7 shutter.

DESCRIPTION OF THE PREFERRED EMBODIMENTS

Figure 1A:
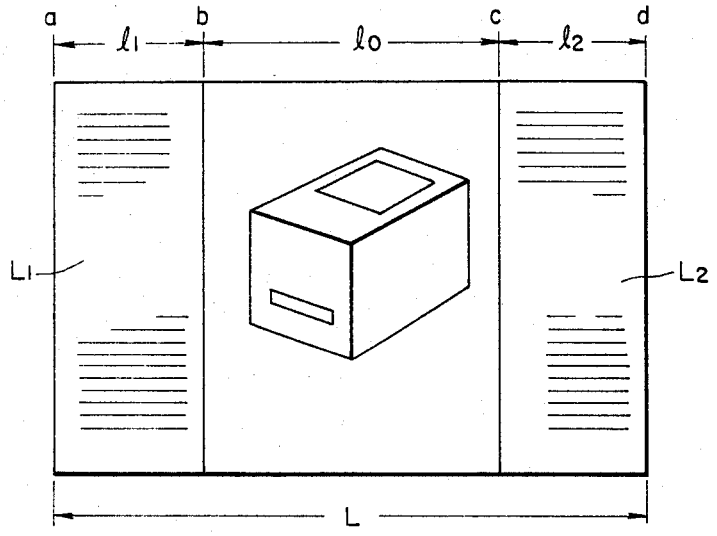
FIG. 1A illustrates an example of a formed image.

Details of the system of the present invention will hereinafter be described by taking as an example a case where the combined image as shown in FIG. 1A is made. For convenience of description, in the following description, it is to be understood that the combined image of FIG. 1A is formed from the left and a side to the right end d side. Also, description will be made on the assumption that the length of an original carriage in the scanning direction is equal to the length L of the combined image. It is also to be understood that an original placed on the original carriage has a length $l_0$ as shown in FIG. 1A.

Figure 2A:
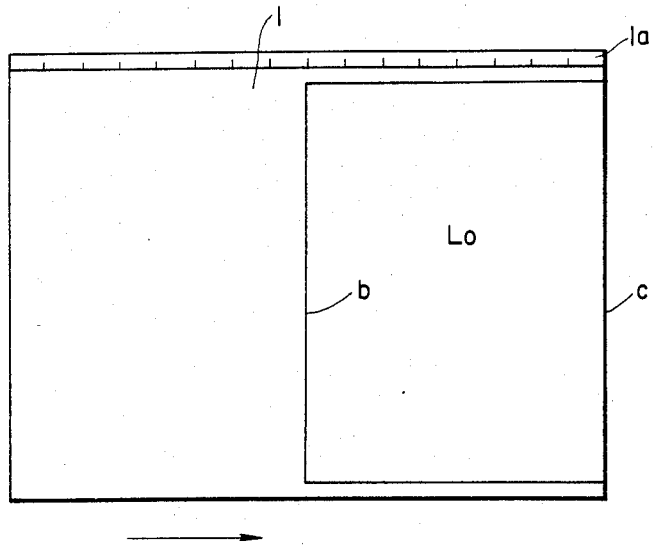
FIG. 2A illustrates the original $L_0$ of the FIG. 1A combined image as placed on the original carriage of the apparatus of the present invention.
Figure 2B:
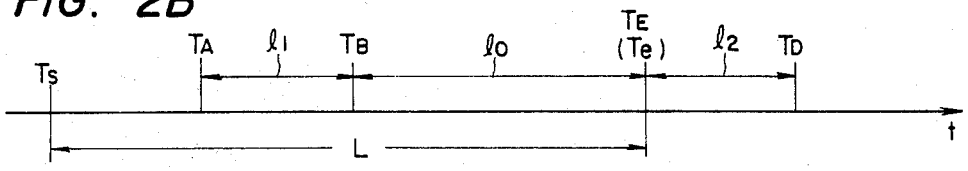
FIG. 2B illustrates the timings based on the image making system of the present invention in the condition of FIG. 2A.

FIG. 2A shows a condition in which the original $L_0$ of FIG. 1A has been placed on the original carriage. The arrow indicates the scanning direction of the original carriage. The original $L_0$ has its position adjusted with the scanning termination side of the original carriage as the standard. Accordingly, the original $L_0$ placed on the original carriage has its right end C made coincident with the rear end of the original carriage in the scanning direction and the left end b is the fore end position. The fore end (left end b) position of the original $L_0$ so disposed is read by an original carriage side end scale 1*a* to thereby accomplish the timing set. FIG. 2B represents the application timing of the optical image of the original and each information image when a combined image is made with the original being set as described above. The figure represents such timing in relation to the scanning of the original carriage.

$T_S$: the time of the original carriage scanning start timing $T_A$: the time when the writing of the information image $L_1$ (area length $l_1$) is started $T_B$: the time when the writing of the information image $L_1$ (area length $l_1$) is terminated/the time when the formation of the image of the original $L_0$ (area length $l_0$) is started $T_E$: the time when the formation of the image of the original $L_0$ (area length $l_0$) is terminated/the time when the writing of the information image $L_2$ (area length $l_2$) is started $T_D$: the time when the writing of the information image $L_2$ (area length $l_2$) is terminated The setting of each start time is effected with the original image formation termination time as the reference. When the scanning speed and recording speed of the original carriage are Vp, the scanning time of the original $L_0$ is $l_0$/Vp and the scanning times of the information images $L_1$ and $L_2$ are $l_1$/Vp and $l_2$/Vp. Accordingly, $T_S$ is $T_E-(l_0+l_1+l_2)/Vp$. Briefly, this is $T_E-L/Vp$. $T_A$ is $T_E-(l_0+l_1)/Vp$ or $T_E-(L-l_2)/Vp$. $T_B$ is $T_E-l_0/Vp$. $T_D$ is $T_E+l_2/Vp$. Thus, each timing time is set with $T_E$ as the reference.

The timing shown in FIG. 2 will further be described. In an image making apparatus, the image making process is started by the start signal of a copy button or the like. Specific steps will later be described, and at time $T_S$, the scanning of the original carriage is started. However, in the system of the present invention, in the case of the combined image shown in FIG. 1, the formation of the optical image $L_0$ of the original (area length $l_0$) is not immediately effected and even the formation of the information image $L_1$ (area length $l_1$) is not started. At time $T_A$, the writing and formation of the information image $L_1$ (area length $l_1$) is started. Then, at time $T_B$, the writing and formation of the information image $L_1$ is terminated and the formation of the optical image $L_0$ of the original (area length $l_0$) is immediately started. At time $T_E$ when the scanning of the original carriage is terminated, the formation of the optical image $L_0$ of the original is terminated. On the other hand, at this time, the writing and formation of the information image $L_2$ (area length $l_2$) is started. At time $T_D$, the writing and formation of the information image $L_2$ is terminated and the formation of a combined image (area length L) is completed on a recording medium. This image is either fixed directly on the recording medium or transferred to a transfer medium for utilization.

Figure 1B:
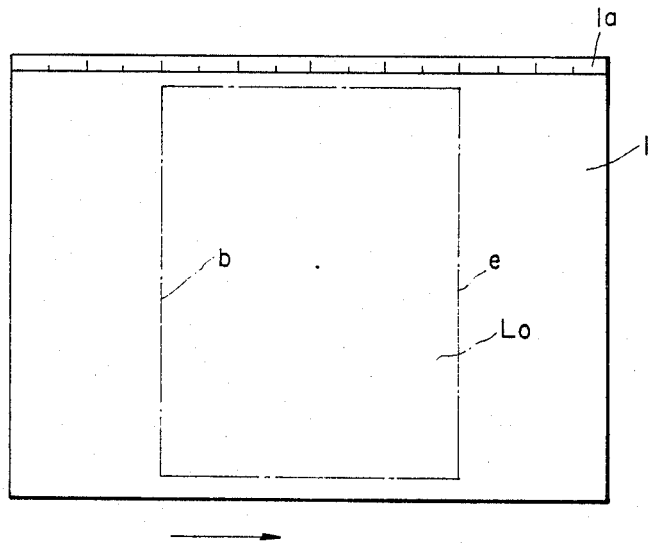
FIG. 1B illustrates the original $L_0$ of the FIG. 1A combined image as placed on the original carriage of a prior art apparatus.

If the rear end c of the original is in advance registered to the reference position on the rear end scanning termination side of the original carriage as previously described when the original image $L_0$ on the original carriage is partly inserted onto a transfer medium having a length equal to the final image length L, the formation start time $T_B$ of the original image $L_0$ is concomitant with the original carriage scanning start time $T_S$ even though the area length $l_0$ of the original image $L_0$ is equal to L, and the time $T_B$ is after $T_S$ where the area length $l_0$ is shorter than L as shown in FIG. 1. However, the start time $T_A$ of the information image $L_1$ based on an inserted electrical signal does never precede $T_S$ when the length of the combined image is prescribed as L. Accordingly, in an image making apparatus wherein the feed control of transfer medium is effected in synchronism with the start of the scanning of the original carriage, normal feeding operation occurs when the area length $l_0$ of the original image is coincident with L, and the feed timing may be delayed by timing rollers even when $l_0<L$. In this manner, the feeding of transfer medium or the like is controlled with great ease. The system whereby the feed timing of transfer medium is controlled in synchronism with the start of the scanning of the original carriage as described above is popular in conventional copying apparatus and is very advantageous where these apparatus are utilized as the image making apparatus of the present invention.

Figure 3A:
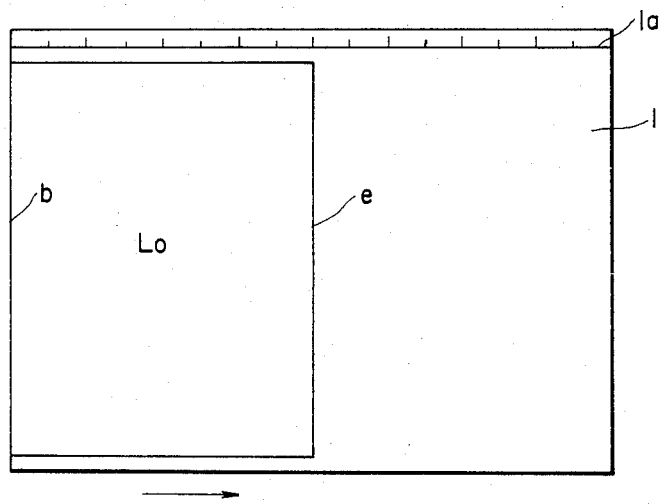
FIG. 3A illustrates an original $L_0$ to be combined as placed on the original carriage in a case where the original $L_0$ is the original carriage fore end standard.
Figure 3B:
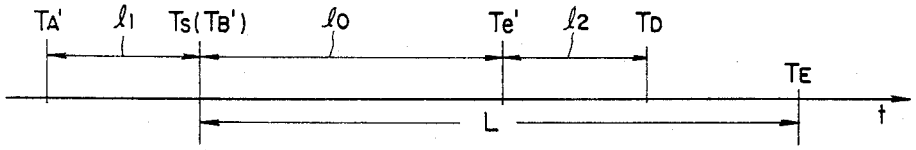
FIG. 3B illustrates the timings in a case where use is made of the original carriage fore end standard shown in FIG. 3A.

FIG. 3A shows, as an example of comparison, a case where the original is adjusted with the fore end of the original carriage (the scanning start side) as the reference, and FIG. 3B shows the control timing therefor. If the combined image as shown in FIG. 1A is to be obtained at this time, the timing $T_A$ at which the writing of the information image $L_1$ based on the electrical signal of the image to be formed is to be started must take place earlier than the original carriage scanning (time $T_S(T_B)$). Accordingly, it is necessary to effect control so that the transfer medium feeding operation itself precedes the scanning of the original carriage. Therefore, the transfer medium feeding operation must independently be effected in synchronism with $T_A'$ and moreover, $T_A'$ differs for each combined image and therefore the control is very difficult.

The system of the present invention is of a construction in which, as described above, the original $L_0$ on the original carriage, unlike the ordinary copying apparatus, has the rear end side thereof in the scanning direction as the reference position and the image of the original between that reference position c and the predetermined forward position b is recorded, and therefore, the timing $T_S$ at which the transfer medium temporarily stopped and held by timing rollers or the like is again started and the timing $T_A$ at which the exposure of the image light is started by a laser light L2 can always be made to succeed to the point of time $T_S$ whereat the scanning optical system starts a predetermined scanning, independently of the area length $l_0$ of the original $L_0$ on the original carriage. Accordingly, actually, it is possible to control the transfer medium re-feeding start $T_S'$ and the laser light application $T_A$ by a timing signal $T_S$ produced after the scanning optical system starts its scanning movement and reaches a predetermined speed. The time from after the timing signal $T_S$ has been produced until a transfer medium is started and the time until the exposure of the image light L2 by the laser is started differ depending on the size of the image to be inserted and the size of the transfer medium, but it is easy to control these times.

According to the present invention, as previously described, after the scanning optical system has started its operation, the timing for other operation can be determined with that operation as the reference. Generally, the scanning optical system effects reciprocal movement and therefore, even if the operation thereof is started on the basis of a control signal, some time is required until a predetermined operation is entered, and that time unavoidably has more or less irregularity and it is difficult to accurately start the operation by the control signal. In contrast, according to the present invention, other members can be controlled with the operation of the scanning optical system as the reference and therefore, control can be effected by control means using a conventional electric circuit and the designing thereof is easy to those skilled in the art.

Figure 4:
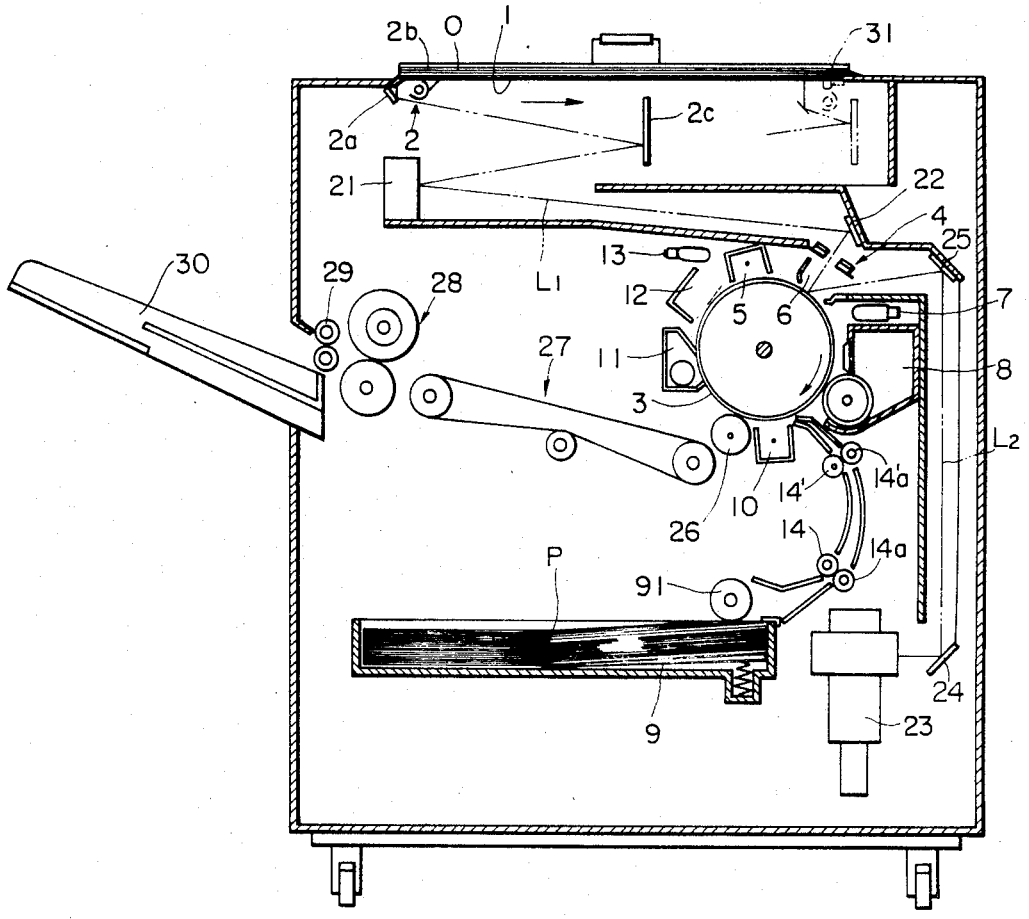
FIG. 4 is a front view of an image making apparatus to which the system of the present invention is applied.

FIG. 4 shows an example of the electrophotographic copying apparatus suitable for carrying out the system of the present invention. In FIG. 4, reference numeral 1 designates an original carriage, and reference numeral 2 denotes a scanning optical system. A movable mirror 2*a* and an original carriage illuminating light source 2*b* are moved together to scan along the original supporting surface. A movable mirror 2*c* is moved at ½ of the speed of the mirror 2*a*. The scanning optical system 2 during its movement in the direction of arrow scans the original O. An original rear end position adjusting member 31 is provided on the scanning termination end side of the original carriage. As an original rear end reference position adjusting member, a projected portion capable of knocking against the original may be formed at the rear end of the original supporting surface and in addition, a reference mark or the like may be provided thereat. The photosensitive medium 3 on the drum basically comprises three layers, i.e., an electrically conductive substrate, a photoconductive layer and an insulating layer. The photosensitive medium is rotated in the direction of arrow by drive means, not shown. Around the photosensitive drum, there are disposed, as latent image forming means, a primary charger 5 applying corona discharge of a predetermined polarity, a secondary charger 6 applying corona discharge having a component of the opposite polarity to the primary change (namely, DC of the opposite polarity, AC, or biased AC of the opposite polarity), and a whole surface exposure source 7. The back of the secondary charger 6 is optically opened so that the optical image of the original scanned by the scanning optical system is applied to the surface of the photosensitive medium via an in-mirror lens 21 and a reflecting mirror 22. Designated by L1 is the optical path of the optical image of the original. Reference numeral 4 denotes a shutter provided in the optical path for closing the optical path during the application of a light beam to be described. A light beam such as a laser light modulated by an electrical signal can also be applied from the back side of the secondary charger 6 to the surface of the photosensitive medium via a light beam generating and scanning system 23 and reflecting mirrors 24, 25. Denoted by L2 is the optical path of the light beam.

Developing means 8 is disposed at a location subsequent to the latent image forming means along the periphery of the photosensitive drum to develop the formed latent image. At an image transfer station further subsequent to the developing means, there is disposed an image transfer corona discharger 10. Transfer mediums P contained in a paper supply cassette 9 are fed one by one to the image transfer station by feeding means such as a pickup roller 91, first timing rollers 14, 14*a* and second timing rollers 14', 14*a'*. Transfer medium separating means 26 is disposed adjacent to the image transfer corona discharger 10 to separate the transfer medium from the photosensitive medium after termination of the image transfer. Designated by 27 is a conveyor belt for conveying the separated transfer medium, and denoted by 28 is fixing means. Reference numeral 29 designates transfer medium discharge rollers for discharging the transfer medium outwardly of the machine after fixation. Reference numeral 30 denotes a tray for receiving the transfer medium discharged by the discharge rollers 29. On the other hand, along the periphery of the photosensitive drum after the image transfer station, there are disposed cleaning means 11, a discharging corona discharger 12 and a discharging lamp 13 in preparation for further image formation.

In the image making apparatus of the above-described construction, a combined image of the optical image of the original O on the original carriage and the information image of the light beam modulated by an electrical signal is obtained on the basis of the system of the present invention as described above. The details thereof will hereinafter be described by reference to a control circuit and flow charts.

Figure 5:
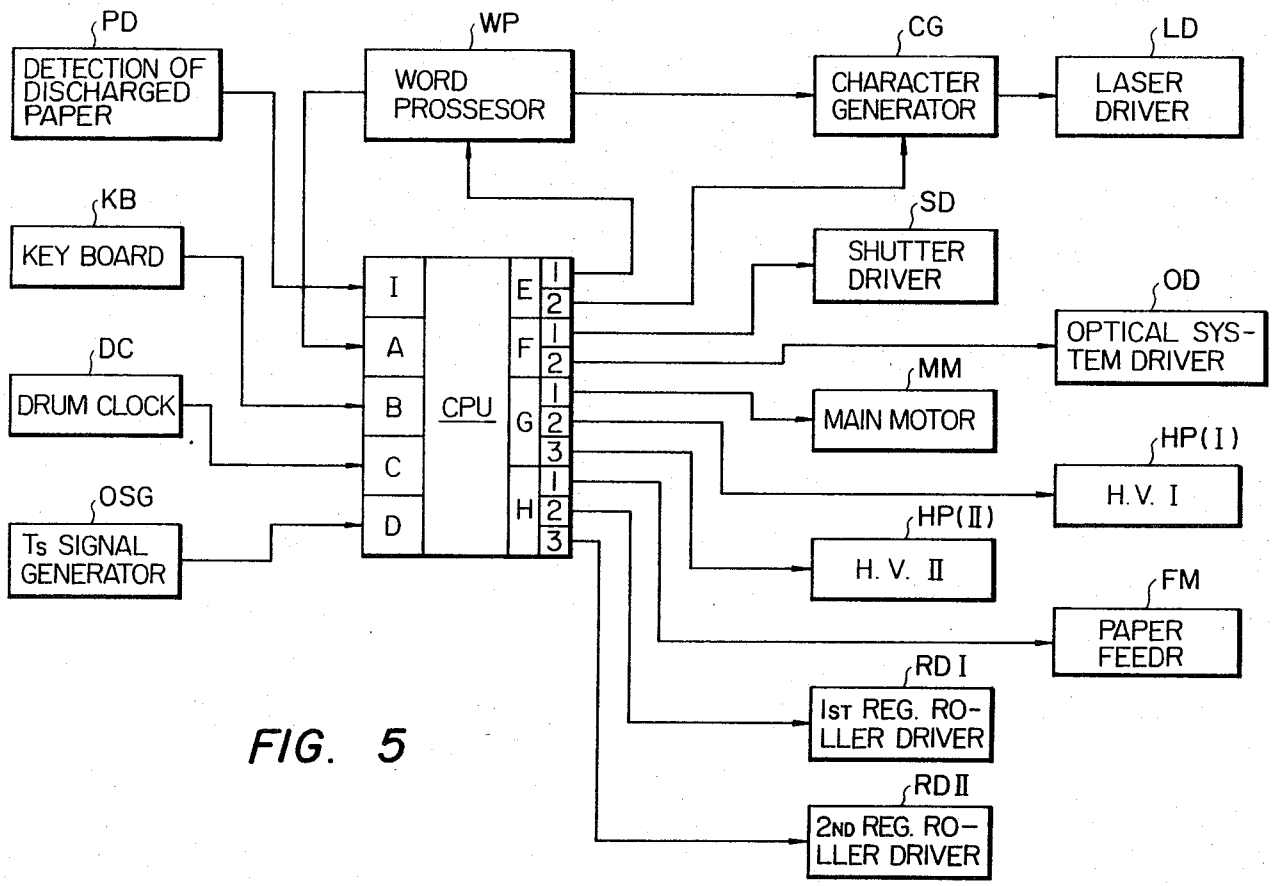
FIG. 5 is a block diagram of the control circuit of the FIG. 4 apparatus.
Figure 6A:
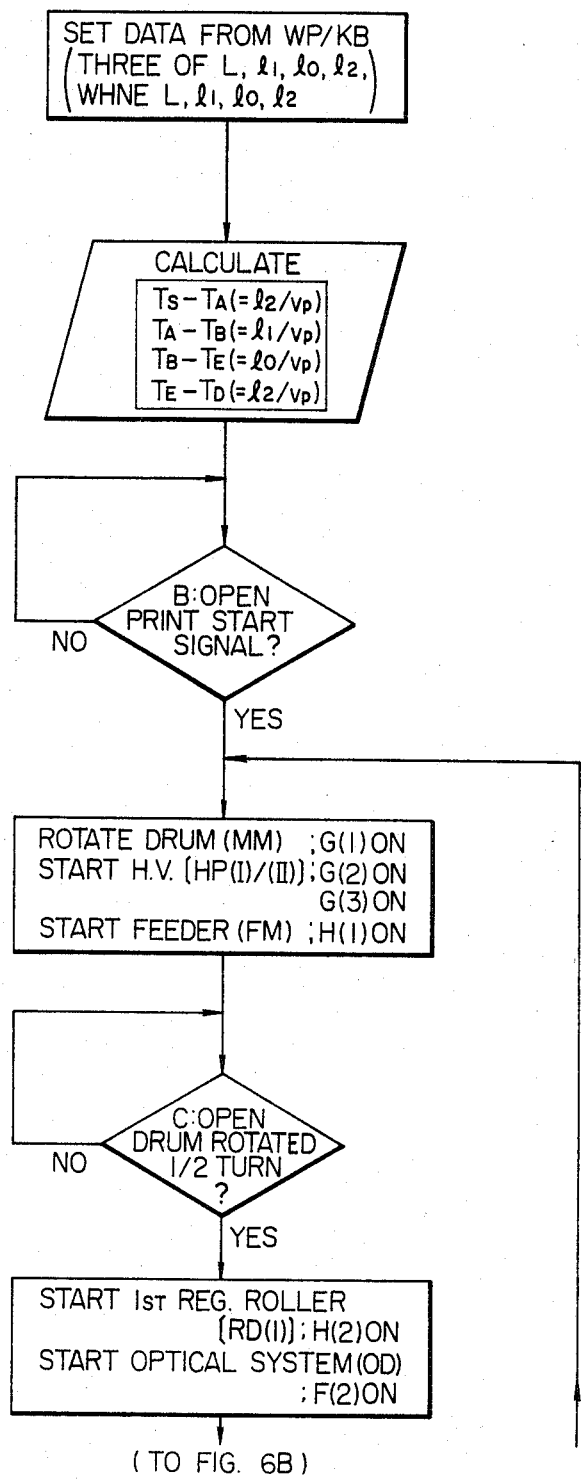
FIGS. 6A–C are flow charts illustrating the control operation when the combined image of FIG. 1A is formed by the apparatus of FIG. 4.
Figure 6B:
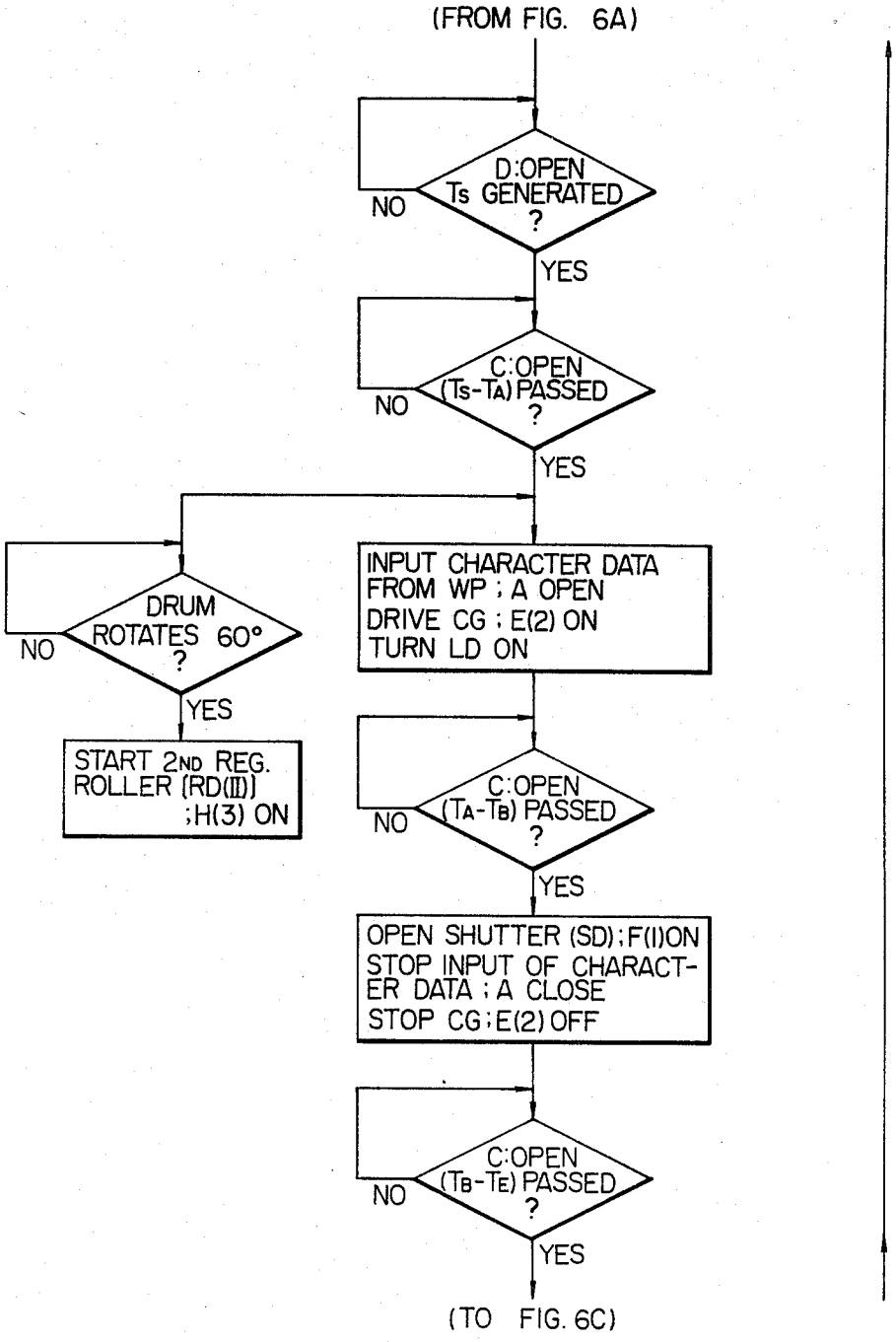
Figure 6C:
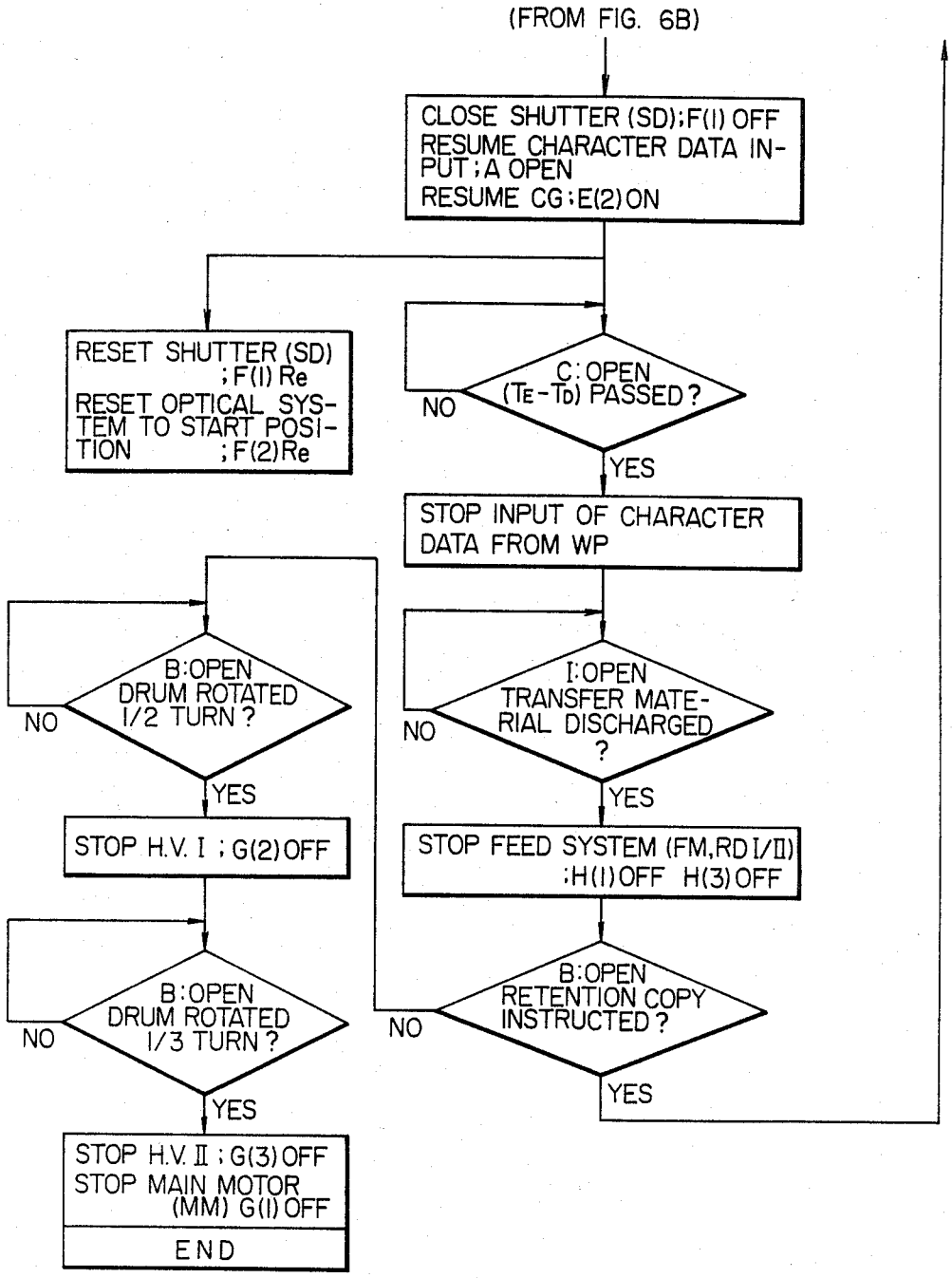

FIG. 5 is a block diagram of the control circuit of the FIG. 4 apparatus, and FIGS. 6A–C are flow charts illustrating the control condition of the image making operation based on the control circuit.

In the control circuit, on the input side with CPU as the center, the information output of a word processor WP which imparts the information for the formation of information image is connected to A, the operation instruction from a keyboard KB is connected to B, a drum clock DC with the photosensitive drum as the reference is connected to C, a signal generator OSG generating the scanning start timing signal $T_S$ of the original carriage scanning optical system is connected to D, and a discharged paper detector PD for confirming the conveyance of the transfer medium such as the discharge of the transfer medium out of the machine is connected to I. On the other hand, on the output side of CPU, E(1) and WP are connected to impart an instruction such as information reading instruction to the word processor WP, and E(2) and a character generator CG are connected to impart an instruction to the character generator CG which is operated during the recording of the light beam. The output of the character generator CG is connected to a laser driver LD. The output ends F(1) and F(2) of CPU are respectively connected to a shutter driver SD for opening and closing the optical path of the optical image of the original and an optical system driver OD. Further, the output ends G(1), G(2) and G(3) of CPU are respectively connected to the main motor MM of the image making apparatus, a high voltage source I (HP(I)) for supplying a high voltage to the primary charger, etc. (except the secondary charger), and a high voltage source II (HP(II)) for the secondary charger. The output ends H(1), H(2) and H(3) of CPU are respectively connected to a paper feeder FM for operating the drive roller on the conveyance path of transfer medium, a first register roller driver RDI such as pickup roller 91 and first register rollers 14, 14*a* for feeding transfer mediums from the paper supply cassette and setting them to the paper feed start position, and a second register roller driver RDII. The second register roller driver RDII is for delaying the feed timing of transfer medium in accordance with the leading end position of the combined image and bringing the combined image during the entry of transfer medium into the image transfer station into coincidence with the leading end of the transfer medium.

FIG. 6 shows the condition of the control of the image making in which the formation of the combined image as shown in FIG. 1A is carried out of the FIG. 4 apparatus having the above-described control circuit. First, on the original carriage of the image making apparatus, an original to be used for combination of images is set with the rear end thereof as the reference, as shown in FIG. 2A. The fore end position of the original is then read by the scale 1*a* provided at one end of the original carriage. Of course, the scale may be replaced by a position reading mechanism which may automatically read the fore end position with its index mark registered to the fore end position. On the other hand, in the word processor WP, information signal to be used for combination of images is prepared by a magnetic tape or a floppy disc to render it possible to impart the information to CPU. Also, by the keyboard KB of the image making apparatus, the area lengths of the above-described optical image and the information images of the combined image are designated and further, the required number of combined images is set. When the area lengths $l_0$, $l_1$ and $l_2$ corresponding to the optical image $L_0$ and the information images $L_1$ and $L_2$ are designated, the scanning time of each area is calculated by CPU. That is, when the peripheral speed of the photosensitive drum is Vp, the scanning times of the above-mentioned images $L_0$, $L_1$ and $L_2$ are $l_0/Vp$, $l_1/Vp$ and $l_2/Vp$, respectively. Each control timing is calculated and set as previously described for the original scanning termination time $T_E$ which is maintained constant for the purpose of controlling the image making apparatus. Specifically, $T_S$ is $T_E-L/Vp$. $T_A$ is $T_E-(L-l_2)/Vp$, and $T_B$ is $T_E-l_0/Vp$. $T_D$ is $T_E+l_2/Vp$. In the image making by the system of the present invention, the combined image formation start timing is never earlier than the original carriage scanning start time $T_S$. In the case of the image combination shown in FIG. 1, the timings are in the order of $T_S$, $T_A$, $T_B$, $T_E$, $T_D$ in the lapse of time of the actual control operation and therefore, only the order of lapse of said timings is shown in the flow chart of FIG. 6. Combination of the optical image and the information images in a predetermined order is effected in accordance with the timings set as described above.

FIG. 7 is a front view showing the opening condition of an embodiment of the shutter 4 used in the apparatus of FIG. 4, and FIGS. 8A–C are transverse cross-sectional views illustrating the manner of operation thereof.

When a shutter opening signal by which the condition changes over from the closed condition of FIG. 8A, namely, the application of the electrical signal image light L2 to the application of the original image light L1 is produced at the position b of the original carriage 1, a rope 18 is pulled in the direction of arrow g indicated in the left lower portion of FIG. 7 by the operation of the control mechanism, and a parallel link mechanism 19 lying at a dots-and-dash line position in FIG. 7 falls down to a solid-line position about a shaft 20 on a fixed base plate 17 to cause shutter films 15 and 16 in the direction of movement of the photosensitive medium to move in the direction of movement of the photosensitive medium 3 at a speed substantially equal to the speed thereof and open as shown by the solid line in FIG. 7 or as shown in FIG. 8B. At this time, the application of the light L2 is stopped.

When a rope 18*a* is pulled in the direction of arrow qa by a shutter closing signal, a parallel link mechanism 19*a* cocks in the same manner as the link 19 with a shaft 20*a* as the fulcrum to cause shutter films 15*a* and 16*a* on the rear side in the direction of movement of the photosensitive medium to move at a speed substantially equal to the speed of movement of the photosensitive medium and close as shown in FIG. 8C. Thereafter, the ropes 18 and 18*a* are pulled in the opposite directions of arrows r and ra, respectively, and the shutter films 15, 16, 15*a* and 16*a* move to the positions of FIG. 8A while remaining closed, thus becoming ready for the next opening operation.

The ropes 18 and 18*a* are operatively associated with a photosensitive medium driving system so that, as described above, the opening speed of the shutter films 15 and 16 on the fore side in the direction of movement of the photosensitive medium and the closing speed of the shutter films 15*a* and 16*a* on the rear side in said direction of movement are substantially equal to the speed of movement of the photosensitive medium 3, and the ropes 18 and 18*a* are pulled by a control mechanism, not shown, which is responsive to shutter opening-closing control signal.

Although the example of FIG. 4 uses a three-layer photosensitive medium as the photosensitive medium and has followed the previously described NP process, a photosensitive medium comprising only an electrically conductive substrate and a photoconductive layer may also be used. In this latter case, image formation can be accomplished only be the charging and exposure steps and therefore, the discharging simultaneous with the image exposure is not effected and uniform exposure need not be effected. In that case, the exposure by the laser light and the exposure by the original light need not always be carried out at a time, but may be carried out in succession. Further, these exposures need not always be carried out at the same position, but may be carried out at different positions. Of course, other various known image-making methods can be utilized. It is of course possible to use the exposure by OFT or the like instead of the exposure by laser light.

What I claim is:

1. An image forming apparatus capable of forming a combined image including an image corresponding to an original and an image corresponding to an information signal comprising:

a movable member;

an original supporting means;

scanning means movable relative to said original supporting means for scanning the original;

an adjusting member to set the position of the rear end of the original, the adjusting member being mounted on said original supporting means at a position along the side of which the scanning of the original by said scanning means is completed;

conveying means to convey a transfer material toward said photosensitive member;

variable setting means for setting a first time during the imaging operation for initiating the projection of light corresponding to said information signal to said photosensitive member, and for setting a second time, which is later than said first time, for initiating the projection of light corresponding to the original to said photosensitive member; and setting means for setting a time for initiating the movement of said conveying means in correspondence with the said first time.

2. An image forming apparatus according to claim 1, wherein said apparatus further comprises shutter means arranged in a light path between said photosensitive member and said original supporting means to open at said second time.

* * * * *

UNITED STATES PATENT AND TRADEMARK OFFICE

CERTIFICATE OF CORRECTION

PATENT NO. : 4,514,081

DATED : April 30, 1985

INVENTOR(S) : YASUYUKI TAMURA

It is certified that error appears in the above-identified patent and that said Letters Patent is hereby corrected as shown below:

In the Abstract, line 3, change "having scanned" to --having been scanned from--.

Column 1, line 21, insert --a-- before "CRT";
line 25, change "can" to --could--;
line 30, change "This" to --There--;
line 35, insert --a-- before "combination";
line 42, change "position and an" to --position. An--.

Column 2, line 39, change "in" to --of--;
line 47, change "standard" to --standard,--.

Column 3, line 23, change "and a" to --end a--.

Column 4, line 40, change "does never precede" to --never precedes--.

Column 6, line 59, insert --the-- before "CPU".

Column 7, line 4, insert --the-- before "CPU";
line 5, insert --an-- before "information";
line 15, insert --the-- before "CPU";
line 21, insert --the-- before "CPU";
line 29, insert --the-- before "transfer";
line 31, insert --the-- before "transfer";
line 47, insert --the-- before "information";
line 50, insert --the-- before "CPU";
line 58, insert --the-- before "CPU".

Column 8, line 54, insert --a-- before "shutter";
line 62, change "be" second occurrence to --by--;
line 67, change "a time," to --the same time,--.

UNITED STATES PATENT AND TRADEMARK OFFICE

CERTIFICATE OF CORRECTION

PATENT NO. : 4,514,081

DATED : April 30, 1985

INVENTOR(S) : YASUYUKI TAMURA

It is certified that error appears in the above-identified patent and that said Letters Patent is hereby corrected as shown below:

Column 8, line 22, change "and a" to read --.A--.

Signed and Sealed this

*Twenty-fifth* Day of *March 1986*

[SEAL]

*Attest:*

DONALD J. QUIGG

*Attesting Officer*

*Commissioner of Patents and Trademarks*